US007448935B2

(12) United States Patent
Trageser et al.

(10) Patent No.: US 7,448,935 B2
(45) Date of Patent: Nov. 11, 2008

(54) LIQUID ACTIVATED TOYS AND OPERATING SYSTEMS FOR USE WITH SAME

(75) Inventors: Mark Trageser, Los Angeles, CA (US); Kip Pohlman, Los Angeles, CA (US); Don Wayne Stoner, Lakewood, CA (US); E. Ernst Ginkel, La Verne, CA (US); Raymond J. Martin, Torrance, CA (US)

(73) Assignee: Mattel Inc., El Segundo, CA (US)

( * ) Notice: Subject to any disclaimer, the term of this patent is extended or adjusted under 35 U.S.C. 154(b) by 548 days.

(21) Appl. No.: 10/993,794

(22) Filed: Nov. 19, 2004

(65) Prior Publication Data

US 2005/0202749 A1 Sep. 15, 2005

Related U.S. Application Data

(60) Provisional application No. 60/530,549, filed on Dec. 17, 2003, provisional application No. 60/525,607, filed on Nov. 25, 2003, provisional application No. 60/524,319, filed on Nov. 21, 2003.

(51) Int. Cl.
*A63H 3/52* (2006.01)

(52) U.S. Cl. ..... 446/267; 446/436; 446/175

(58) Field of Classification Search ..... 446/267, 446/484, 175, 436
See application file for complete search history.

(56) References Cited

U.S. PATENT DOCUMENTS

| | | | |
|---|---|---|---|
| 2,056,052 | A | 9/1936 | Mason |
| 2,583,434 | A | 1/1952 | Meyer |
| 2,852,645 | A | 9/1958 | Cid |
| 3,030,477 | A | 4/1962 | Hensley |
| 3,035,132 | A | 5/1962 | Görike et al. |
| 3,162,980 | A | 12/1964 | Hellman |

(Continued)

FOREIGN PATENT DOCUMENTS

| | | |
|---|---|---|
| GB | 290767 | 5/1928 |

(Continued)

OTHER PUBLICATIONS

"Guzzlers"™ product packaging (2 pages); © Ideal Toy Corporation 1980.

(Continued)

*Primary Examiner*—Robert E Pezzuto
*Assistant Examiner*—Alex F. R. P. Rada, II
(74) *Attorney, Agent, or Firm*—Kolisch Hartwell, P.C.

(57) ABSTRACT

Toys and toy operating systems for use therein. A toy operating system may include an input system responsive to a predetermined quantitative characteristic of a liquid body, such as electrical conductivity, and a response system coupled to the input system and configured to generate one or more toy output patterns based at least in part on the given characteristic. A toy vehicle for use with such an operating system may include a chassis, a chamber adapted to contain a liquid body, and at least one toy component operable to display an output according to a generated output pattern. Exemplary toy components include an audiovisual assembly to produce an audiovisual display and a drive assembly to move the toy vehicle across a ground surface.

25 Claims, 3 Drawing Sheets

U.S. PATENT DOCUMENTS

| | | | | | |
|---|---|---|---|---|---|
| 3,342,138 | A | | 9/1967 | Parks et al. | |
| 3,477,460 | A | | 11/1969 | Dotto | |
| 3,498,131 | A | | 3/1970 | Rickey | |
| 3,530,855 | A | | 9/1970 | Balding | |
| 3,823,874 | A | | 7/1974 | Kroeck | |
| 3,944,966 | A | | 3/1976 | Rubega | |
| 3,998,551 | A | | 12/1976 | Suga | |
| 4,138,600 | A | | 2/1979 | Ozols | |
| 4,140,015 | A | | 2/1979 | Roley | |
| 4,282,681 | A | | 8/1981 | McCaslin | |
| 4,347,683 | A | | 9/1982 | Maxim | |
| 4,547,169 | A | * | 10/1985 | Maxim | 446/267 |
| 4,701,150 | A | | 10/1987 | Alvarez | |
| 5,326,301 | A | | 7/1994 | Woodside | |
| 5,478,267 | A | | 12/1995 | McDonald et al. | |
| 5,499,940 | A | | 3/1996 | Johnson et al. | |
| 5,941,754 | A | | 8/1999 | Maxim | |
| 6,054,156 | A | | 4/2000 | Rudell et al. | |
| 6,129,292 | A | | 10/2000 | Leung et al. | |
| 6,163,258 | A | | 12/2000 | Rudell et al. | |
| 6,398,613 | B1 | | 6/2002 | Rehkemper et al. | |

FOREIGN PATENT DOCUMENTS

| | | | |
|---|---|---|---|
| GB | 348599 | | 5/1931 |
| GB | 576088 | | 3/1946 |
| GB | 606851 | | 8/1948 |
| GB | 925125 | | 5/1963 |
| JP | 5-30475 | | 2/1993 |
| JP | 10-156041 | | 6/1998 |
| JP | 10-263212 | | 10/1998 |
| JP | 2000089654 | | 3/2000 |
| JP | 2000-262766 | * | 9/2000 |
| WO | WO0174463 | | 10/2001 |

OTHER PUBLICATIONS

"Liq-Walker" product packaging (2 pages); Childford © 2003.
Picture of Bandai Robot product (2 pages).

* cited by examiner

LIQUID ACTIVATED TOYS AND OPERATING SYSTEMS FOR USE WITH SAME

RELATED APPLICATIONS

This application is based upon and claims priority under 35 U.S.C. § 119(e) to the U.S. Provisional Patent Applications No. 60/524,319 filed on Nov. 21, 2003, No. 60/525,607 filed on Nov. 25, 2003, and No. 60/530,549 filed on Dec. 17, 2003, the disclosures of which are incorporated herein by reference in their entirety for all purposes.

TECHNICAL FIELD

The present disclosure relates generally to toys in which the performance of the toy is a function of a predetermined quantitative characteristic of a chosen liquid, and more particularly to toy vehicles configured to exhibit one or more toy output patterns based on the electrical conductivity of a chosen liquid.

SUMMARY

The present disclosure relates generally to toys in which the performance of the toy is a function of a given characteristic of a chosen liquid. An operating system for such a toy may include an input system responsive to a predetermined quantitative characteristic of a liquid, and a response system coupled to the input system and configured to generate one or more toy output patterns based at least in part on the given characteristic. In some embodiments, the toy is a battery-powered toy vehicle with a chamber for containing a liquid body, a pair of electrical contacts to measure the electrical conductivity of the liquid body, a processor or logic unit to communicate data representative of the measured conductivity, and a response system to operate one or more vehicle features or components of the toy based on the conductivity data communicated according to a predetermined output pattern. In some embodiments, the chamber is detachable from the toy vehicle. Exemplary components may include a drive assembly to provide a motive force for the toy vehicle, such as to move the toy vehicle across a ground surface, and/or an audiovisual assembly including lights and speakers, such as to produce an audiovisual display. Output patterns may include combinations of lights, sounds, and/or toy vehicle movement speed.

In play patterns for use with such a toy vehicle, a user may fill the chamber with a chosen mixture of one or more household liquids (such as water, juice, or a carbonated beverage) according to the user's preference. The contacts then measure the electrical conductivity of the chosen liquid mixture, and the processor prompts the response system to produce an output pattern that may simulate whether or not the chosen mixture is an appropriate "fuel" for the vehicle. Thus, a user may try several different liquid mixtures in order to discover an optimum "fuel" mixture that produces a user-preferred output pattern.

Examples of fluid activated devices are found in U.S. Pat. Nos. 4,347,683 and 4,547,169, Japanese Patent Application No. 2000-089654, and publication WO0174463, the disclosures of which are incorporated herein by reference.

DETAILED DESCRIPTION

Figure 1:
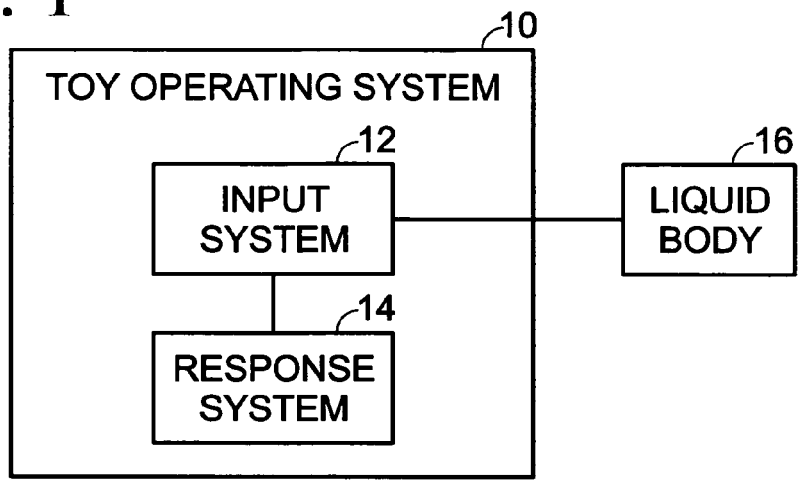
FIG. 1 is a block diagram of a toy operating system suitable for use with a toy of the present disclosure.

FIG. 1 shows a schematic representation of a toy operating system 10. The operating system includes an input system 12 and a response system 14. Input system 12 is coupled with a liquid body 16, and is configured to be responsive to a predetermined quantitative characteristic or chemical property of the liquid body, such as electrical conductivity. A liquid body may be any volume of liquid, such as a mixture of one or more liquids contained in a reservoir or other receptacle, a mixture of solid and liquid matter, and so forth. Input system 12 is thus configured to measure or otherwise nonconsumptively determine the characteristic and also to communicate data or other information representative of the measured characteristic to response system 14. Response system 14 is configured to generate one or more predetermined toy output patterns, based at least in part on the communicated data or information.

Figure 2:
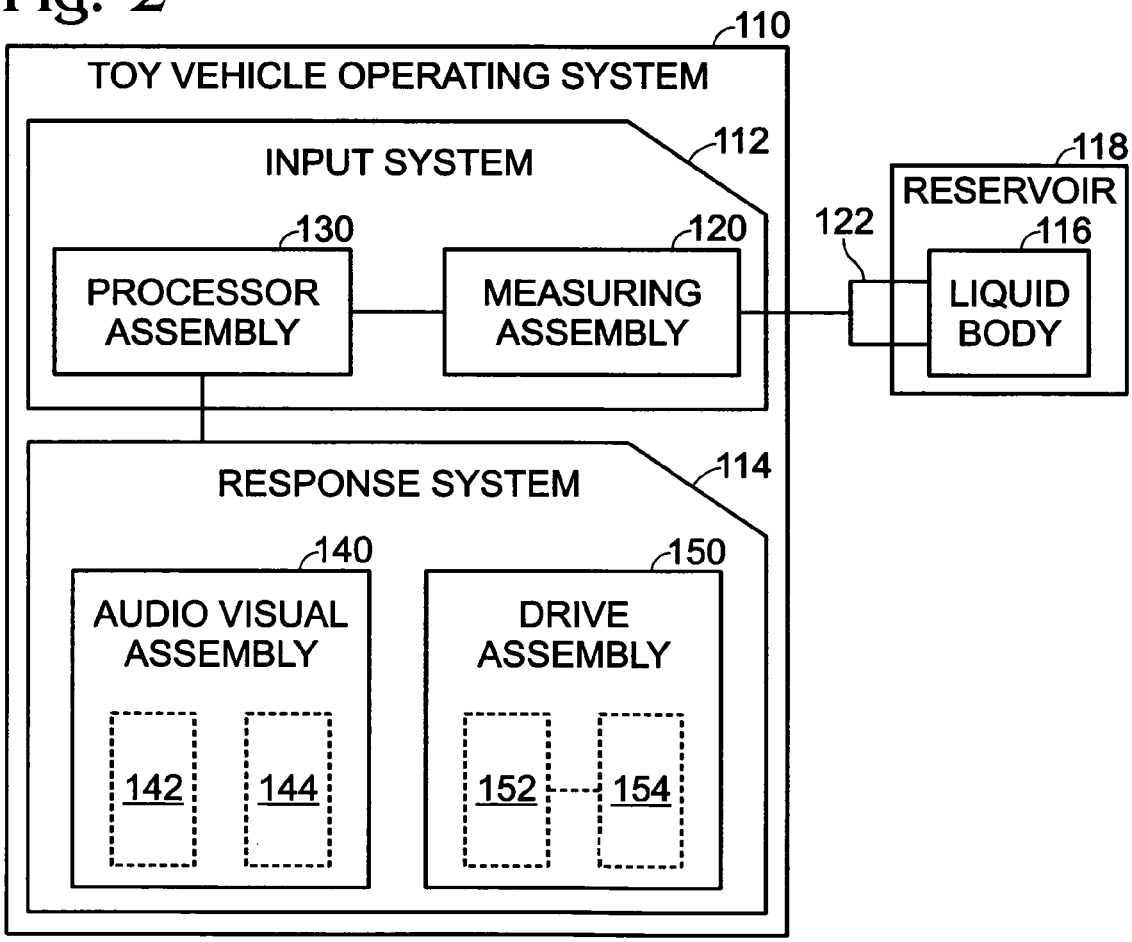
FIG. 2 is a block diagram of an exemplary embodiment of a toy vehicle operating system.

A non-limiting exemplary embodiment of toy operating system 10 is shown in FIG. 2 as a toy vehicle operating system 110. Toy vehicle operating system 110 includes an input system 112 and a response system 114, and is coupled with a liquid body 116 contained in a reservoir 118. Reservoir 118 may be any receptacle adapted to contain a liquid body 116, such as a liquid receiving chamber that may be detachably coupled with toy vehicle operating system 110.

As with the components of toy operating system 10 as explained above, input system 112 is configured to measure a given characteristic of liquid body 116, and response system 114 is configured to generate one or more predetermined toy output patterns based at least in part on the measurement.

As explained in more detail below, in some embodiments of toy vehicle operating system 110, input system 112 may be configured to measure the electrical conductivity of a liquid body in reservoir 118, and response system 114 may be configured to generate a toy output pattern based on the measured electrical conductivity. Thus, response system 114 may be configured to generate different toy output patterns when liquids or liquid mixtures having different conductive properties are placed in reservoir 118. For example, a first predetermined toy output pattern may correspond to a liquid mixture having an electrical conductivity in a first range, and a second predetermined toy output pattern may correspond to another liquid mixture having an electrical conductivity in a second range.

Input system 112 further includes a measuring assembly 120 to measure the selected, or predetermined, characteristic.

Toy vehicle operating system 110 is configured to be responsive to the electrical conductivity of liquid body 116. Thus, measuring assembly 120 includes a pair of electrical contacts 122 configured to deliver an electrical current through liquid body 116 and thus determine the liquid's electrical conductivity. However, although measuring assembly 120 is shown to include electrical contacts 122, the nature of the characteristic to be measured may determine the structural characteristics and/or components of the measuring assembly. As such, a toy operating system configured to be responsive to other liquid properties may include devices, instruments, or other structural components appropriate for nonconsumptive measurement of one or more of such quantitative properties of a liquid body.

Input system 112 also includes a processor assembly 130 coupled to measuring assembly 120. Processor assembly 130 is configured to produce information representative of the measurement of the liquid characteristic. More particularly, in the exemplary toy vehicle operating system, processor assembly 130 is configured to produce operational instructions, or inputs, for one or more components of response system 114 based on the measured electrical conductivity of a liquid body 116.

Different liquids may have different electrical conductivities within a measurable spectrum extending from completely nonconductive (i.e. the liquid does not conduct electricity) to completely conductive (i.e. current flows through the liquid with no resistance). In the exemplary toy vehicle operating system, processor assembly 130 is configured to produce a predetermined set of operational instructions, prompting a corresponding toy output pattern, based on the liquid's conductivity as measured by measuring assembly 120. For example, if a liquid's electrical conductivity is within a first conductivity range within the spectrum, a first set of predetermined operational instructions may be produced, which prompt a first corresponding output pattern, but if a liquid's electrical conductivity is within a second conductivity range, a second predetermined set of operational instructions may be produced, which prompt a second corresponding output pattern. However, a toy vehicle operating system may be configured to produce any desired number of sets of operational instructions and/or output patterns to correspond with any desired number of ranges.

Processor assembly 130 thus may include any computational device, such as a microprocessor, a logic unit, or any other circuitry adapted to produce information representative of the measured characteristic and to communicate this information to the response system. As described above, such information includes operational instructions for one or more components of response system 114, but may optionally include any data, whether processed, partially processed or unprocessed, or sub-sets of the data, relating to the measured characteristic, which may be communicated to response system 114.

Response system 114 may include components such as an audiovisual assembly 140 to produce a plurality of predetermined audiovisual displays, a drive assembly 150 to provide a motive force for a toy vehicle, such as to move the toy vehicle across a ground surface at a plurality of predetermined rates of speed, and/or additional components, in any desired combination. In the illustrated embodiment, response system 114 is configured to generate a toy output pattern by activating one or more of such components based on the operational instructions and/or other information received from processor assembly 130. The configuration of the various components of a response system, and the nature of the toy output patterns generated, may vary depending on the nature of the toy vehicle used with the toy vehicle operating system.

For example, if toy vehicle operating system 110 is used with a battery-powered toy vehicle such as a toy racecar, audiovisual assembly 140 may further include a light system 142 and/or a speaker system 144. Light system 142 may include one or more lights disposed on the toy vehicle chassis, such as headlights, tail lights, and so forth, and speaker system 144 may include one or more speakers configured to emit sounds consistent with a racecar design, such as a tire squealing or an engine "revving" at various speeds. Activation of audiovisual assembly 140 may thus include producing lights and/or sounds simulating those produced by a racecar. Analogously, drive assembly 150 may further include a motor assembly 152 coupled to a driven wheel assembly 154. Motor assembly 152 may include one or more motors, and driven wheel assembly may include one or more driven wheels adapted to move the toy vehicle across a ground surface. Thus, activation of drive assembly 150 may include prompting motor assembly 152 to provide motive power to a driven wheel of driven wheel assembly 154. Toy output patterns for the toy vehicle may thus include various combinations of lights, sounds, and/or toy vehicle movement speed.

Power for the various component systems of toy vehicle operating system 110 may be supplied by one or more batteries and/or other power sources. Continuing the example above, a toy vehicle for use with toy vehicle operating system 110 may thus include a battery compartment or other structural features to accommodate an onboard power source. Optionally, any suitable form of power source may be used. Further, a power switch may be provided to allow the power source to supply power to the various component systems as required by toy vehicle operating system 110, or to disengage the power supply if the toy vehicle is not in use.

Figure 3:
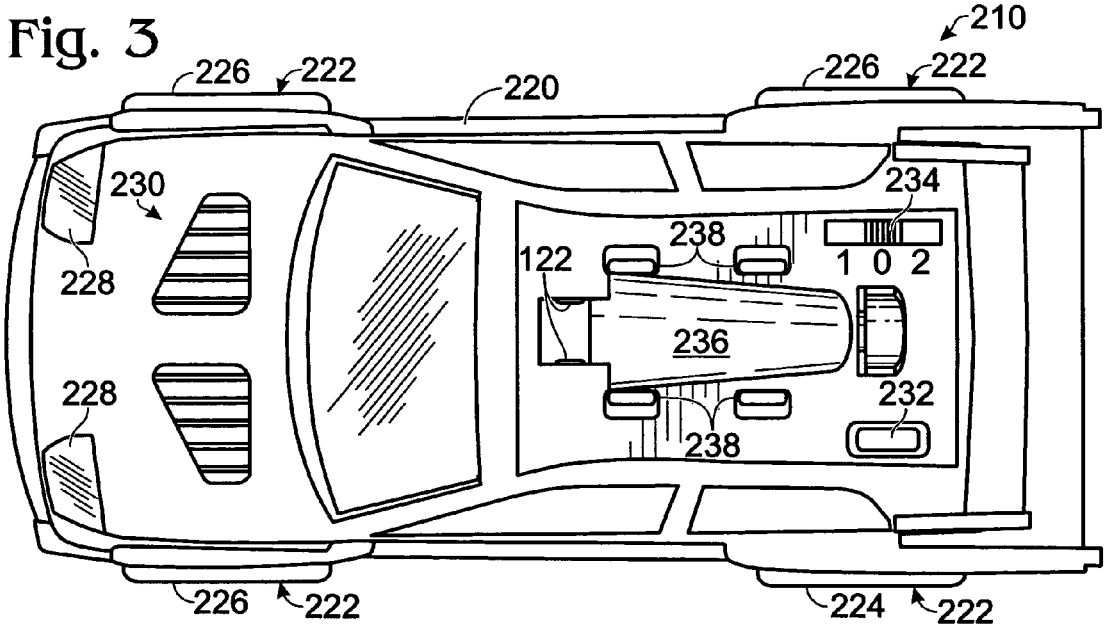
FIG. 3 is a top plan view of an exemplary embodiment of a toy vehicle for use with the toy vehicle operating system of FIG. 2.

FIGS. 3-8 show an exemplary toy vehicle 210 and a liquid receiving chamber 212 that may be used with toy vehicle operating system 110. More particularly, FIG. 3 shows a top view of toy vehicle 210, which includes a chassis 220 shaped to resemble a racecar. Toy vehicle 210 also includes a plurality of wheels 222 mounted on the chassis, which further include a driven wheel 224 and rolling wheels 226. Chassis 220 also includes a plurality of lights 228, a speaker 230, an actuator 232 in the form of a push button, and a power switch 234.

Driven wheel 224, lights 228, speaker 230, and actuator 232 are coupled to various component systems or assemblies of toy vehicle operating system 110. More particularly, driven wheel 224 is coupled with drive assembly 150, and lights 228 and speaker 230 are coupled with audiovisual assembly 140. Actuator 232 is coupled to input system 112. Power switch 234 is coupled to a battery assembly or other power source (not shown), and is configured to engage the power source with, or disengage the power source from, the toy vehicle operating system.

Chassis 220 further includes a recessed channel 236. Retention devices 238 are disposed on either side of recessed channel 236, and visible within recessed channel 236 are electrical contacts 122 of toy vehicle operating system 110.

Figure 4:
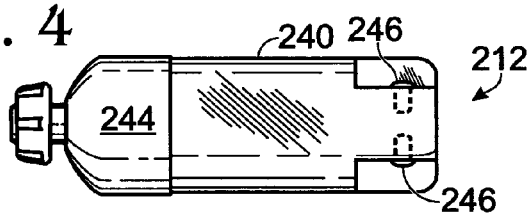
FIGS. 4 and 5 are side elevation views of an exemplary embodiment of a detachable liquid receiving chamber suitable for use with the toy vehicle of FIG. 3.
Figure 5:
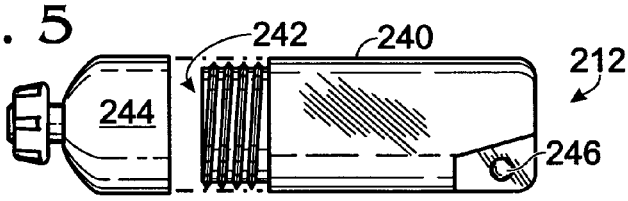

Liquid receiving chamber 212, shown in FIGS. 4 and 5, is configured to contain a liquid body and be detachably coupled to chassis 220 within recessed channel 236. As such, chamber 212 includes substantially cylindrical chamber wall 240 adapted to conform in size and shape with the contour of channel 236 One end of chamber 212 includes an input port 242 for delivery of a liquid into, or from, the chamber. A closure member 244, shown as a screw cap, is adapted to prevent liquid from escaping from chamber 212 through input port 242. A pair of electrodes 246 are disposed on the other end of chamber 212, which protrude through chamber wall 240 and into a liquid body contained in chamber 212. The view shown in FIG. 4 depicts the "bottom" of chamber 212, and the view shown in FIG. 5 depicts one "side" of chamber 212.

Figure 6:
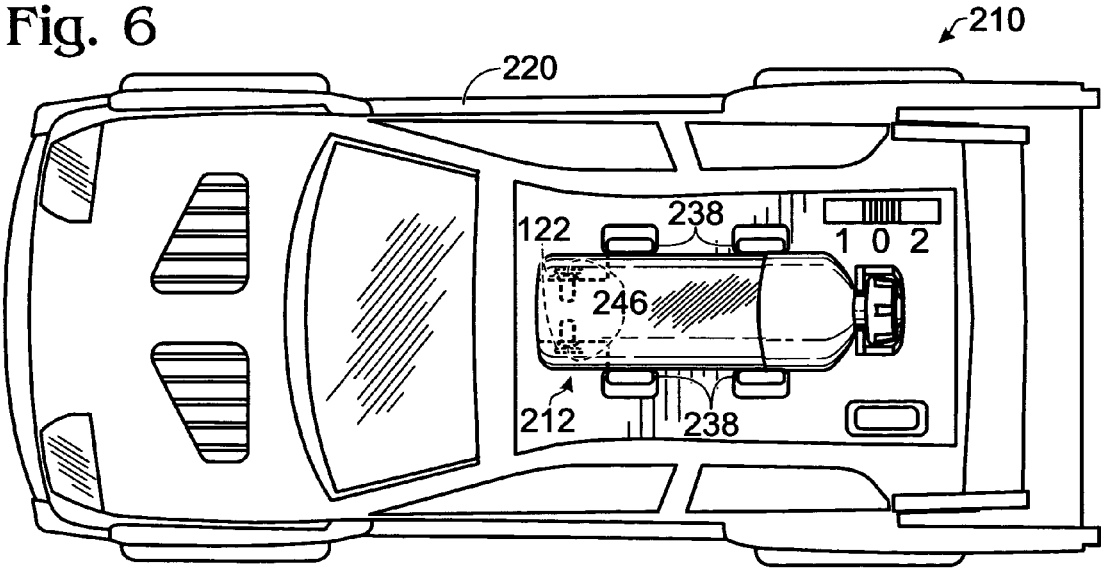
FIG. 6 is a top plan view of the toy vehicle of FIG. 3, showing the liquid receiving chamber of FIGS. 4 and 5 coupled to the toy vehicle.
Figure 7:
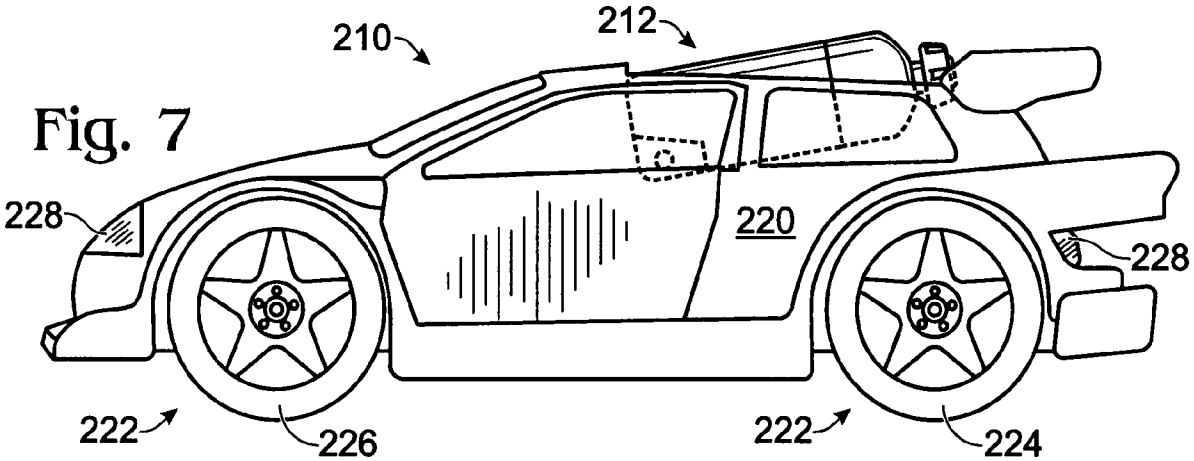
FIG. 7 is a side elevation view of the toy vehicle of FIG. 3, also showing the liquid receiving chamber of FIGS. 4 and 5 coupled to the toy vehicle.

As shown in FIG. 6, when chamber 212 is placed within recessed channel 236 with the "bottom" of the chamber positioned against the surface of channel 236, retention devices 238 are adapted to retain chamber 212 in place until detached from the chassis, and electrical contacts 122 are positioned to press against electrodes 246. FIG. 7 shows a side view of toy vehicle 210 with chamber 212 coupled to chassis 220.

Figure 8:
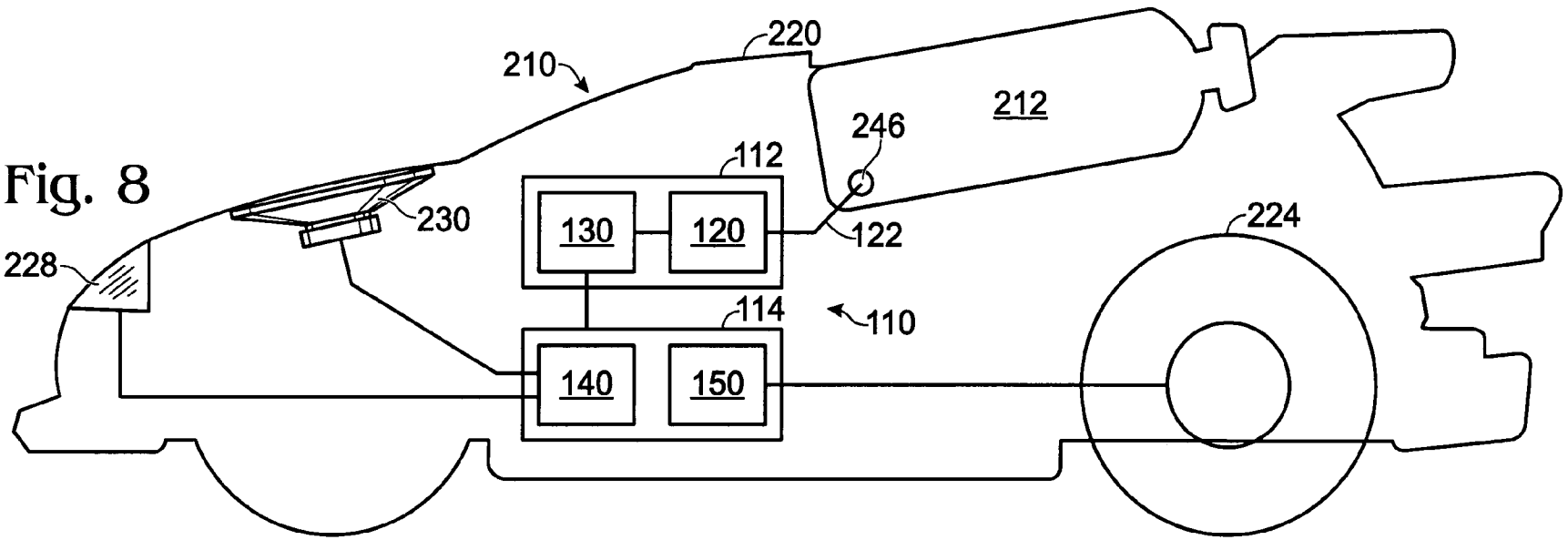
FIG. 8 is a schematic representation of the toy vehicle of FIG. 3 with the toy vehicle operating system of FIG. 2, showing how various components of the toy vehicle operating system are coupled with various components of the toy vehicle.

FIG. 8 shows a schematic representation of toy vehicle operational system 110 as used with toy vehicle 210. When chamber 212 is coupled to chassis 220 as described above, electrical contacts 122 of measuring assembly 120 are positioned against electrodes 246. When actuator 232 (not shown in this view) is depressed, measuring assembly 120 of input system 112 generates an electrical current and measures the current flow between electrodes 246, if any. Processor assembly 130 produces operational instructions and/or other information representative of the measured conductivity and communicates the instructions to response system 114, prompting the components of response system 114 to generate a toy output pattern consisting of a predetermined combination of activation of lights 228 and/or speaker 230, to produce an audiovisual display, and/or provision of power to driven wheel 224, to move the vehicle across a ground surface.

A variety of play patterns are thus available for use with toy vehicle 210. For example, a user may fill chamber 212 with a mixture of one or more household liquids (such as water, juice, or a carbonated beverage) according to the user's preference. The chamber may then be attached to the toy vehicle chassis. The user may then depress the actuator to prompt the measuring assembly to measure the electrical conductivity of the liquid mixture. The processor assembly may then prompt the response system to produce an output pattern.

As mentioned above, in the exemplary toy vehicle operating system, the toy output patterns produced by the toy vehicle, or response system 114, are dependent on the electrical conductivity of the liquid body in chamber 212. Thus, the exemplary toy vehicle will respond differently to liquids or liquid mixtures with different conductive properties. As such, the toy vehicle may simulate whether or not a given liquid or liquid mixture is an appropriate "fuel" for the toy vehicle. A user may try several different liquid mixtures in order to discover an optimum "fuel" mixture that produces a preferred output pattern.

For example, if the conductivity of the liquid or liquid mixture placed in chamber 212 falls within a first conductivity range, the corresponding toy output pattern includes activation of speaker 230 to emit a repeated sound resembling that of an automobile starter, to indicate that the chosen liquid mixture is not an appropriate "fuel." Alternatively, if the conductivity of the liquid or liquid mixture placed in chamber 212 falls within a second conductivity range, the corresponding toy output pattern includes rapid and repeated activation of lights 228, activation of speaker 230 to emit a sound resembling that of an engine starting and revving at a high rate, and activation of drive assembly 150 to move the vehicle across a ground surface at a high rate of speed, to indicate that the chosen liquid mixture is a powerful "fuel."

In the exemplary toy vehicle, the level of the toy vehicle's performance increases with the electrical conductivity of the liquid or liquid mixture contained in chamber 212. The following table is an example of six different toy output patterns that may be generated by response system 114, corresponding to six different electrical conductivity ranges. The conductivity ranges are arbitrarily numbered 0-5 to represent nonconductivity (0) to high conductivity (5).

TABLE 1

| Range | Toy output pattern |
|---|---|
| 0 | Lights do not flash.<br>"Engine ignition 1" sound plays three times with small pauses.<br>Motor remains off.<br>Vehicle does not move. |
| 1 | Lights flash twice per second, for one second.<br>"Engine ignition 1" sound will play at high pitch.<br>Motor on at 100% for short burst, repeated 8 times.<br>Vehicle travels 1-2 feet in chugging motion. |
| 2 | Lights flash 5 times per second, for one second.<br>"Engine ignition 1" sound will play at medium pitch.<br>Motor on at 50%.<br>Vehicle travels 5-10 feet. |
| 3 | Lights flash 10 times per second, for one second.<br>"Engine ignition 1" sound will play at low pitch.<br>Motor on at 67%.<br>Vehicle travels 12-17 feet. |
| 4 | Lights will blink 15 times per second, for one second.<br>"Engine ignition 2" sound will play at high pitch.<br>Motor on at 83%.<br>Vehicle travels 17-22 feet. |
| 5 | Lights will blink 20 times per second, for one second.<br>"Engine ignition 2" sound will play at medium pitch.<br>"Tire squeal" sound will play.<br>Motor on at 100%.<br>Vehicle travels 25-30 feet. |

The toy vehicle may further include further components to augment the vehicle's simulated reaction to different liquid mixtures. For example, the table above refers to different motor outputs. Thus, drive assembly 150 may include any appropriate systems or devices, such as a feedback mechanism, to govern the output of a motor within the toy vehicle. One example of a feedback mechanism consists of a photodiode and LED, which may be positioned on either side of a tach wheel mounted on an axle. As the axle and the tach wheel rotate, a light beam traveling from the LED may be intermittently received by the photodiode through perforations disposed on the periphery of the tach wheel, which are aligned with the path of the light beam. Processor assembly 130 may be coded to count the number of times the light beam is received by the photodiode during a given time increment. This count may allow the processor to control the drive assembly to increase or decrease the motor output to maintain a consistent given vehicle speed.

Such a feedback mechanism may optionally be used to allow the toy vehicle to mimic a response to an inappropriate "fuel." For example, processor assembly 130 may be coded to intermittently interrupt the power supply to drive assembly 150, for example, by employing a random number generator or by means of a count of the number of times the light beam is received by the photodiode. This intermittent interruption of power can be incorporated in a set of operational instructions, which can result in a toy output pattern that includes the vehicle moving in a "chugging" motion, such as to simulate the vehicle's response to an inappropriate "fuel."

Optionally, the exemplary toy vehicle may be operated independent of the conductivity of a liquid in chamber 212, with no liquid in chamber 212, or with chamber 212 detached from toy vehicle 210. Power switch 234 is selectively movable among an "off" position designated by the number 0, a first "on" position designated by the number 1, and a second "on" position designated by the number 2. The first "on"

position allows the toy vehicle to be used with different liquid mixtures as described above, and the second "on" position, for use if a user prefers not to test the toy vehicle's performance using different liquid mixtures, allows the toy vehicle, when actuator 232 is depressed, to respond with a predetermined toy output pattern corresponding to a highly conductive liquid.

The exemplary toy vehicle described herein is intended to be a non-limiting example of a toy vehicle that may be used with the toy operating systems of the present disclosure. As such, several variations are possible and are within the scope of the disclosure. For example, in some embodiments, the toy operating system may be adapted to couple with one or more liquid chambers simultaneously. In some embodiments, one or more liquid chambers may be permanently coupled with the toy operating system. In such embodiments, a user may be allowed to choose from among several liquid chambers. In some embodiments, a liquid chamber may not include an input port, but may rather contain a liquid in a sealed chamber. In some embodiments, a toy vehicle may include a feature or component that allows the chamber to be automatically emptied in a gradual manner while being operated, simulating the consumption of fuel, such as to enhance entertainment value of the toy vehicle.

Although the toy and toy operating system disclosed herein have been described in the context of the exemplary embodiment of a toy vehicle, the disclosed toy operating systems may be used with other toys. For example, a toy doll may be used with a toy operating system that prompts different output patterns based on the measurement of a quantitative characteristic of a liquid contained in a detachable chamber configured to resemble a baby bottle, allowing a user to test different liquids to produce a user-preferred response.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A toy operating system, comprising:

an input system responsive to a predetermined quantitative characteristic of a liquid body;

a measuring assembly to measure the characteristic;

a response system coupled to the input system and configured to generate one or more toy output patterns based at least in part on the given characteristic; and a processor assembly to produce information representative of the measurement and to communicate the produced information to the response system;

wherein the produced information includes a set of one or more operational instructions for the response system.

2. A toy vehicle operating system including the toy operating system of claim 1.

3. A toy vehicle including the toy vehicle operating system of claim 2.

4. The toy operating system of claim 1 wherein the characteristic is electrical conductivity, and wherein the measuring assembly further includes a pair of electrical contacts adapted to measure the electrical conductivity of a liquid.

5. The toy operating system of claim 1, wherein the processor assembly is configured to produce a plurality of sets of one or more operational instructions including a first set and a second set;

wherein the first set of one or more operational instructions is produced when the measurement of the characteristic falls within a first range; and wherein the second set of one or more operational instructions is produced when the measurement of the characteristic falls within a second range different from the first range.

6. The toy operating system of claim 5 wherein the response system is configured to generate a first toy output pattern corresponding to the first set of one or more operational instructions and a second toy output pattern corresponding to the second set of one or more operational instructions, such that the first toy output pattern is different from the second toy output pattern.

7. The toy operating system of claim 1 wherein the response system is configured to generate a toy output pattern corresponding to the measurement of the characteristic.

8. The toy operating system of claim 1 wherein the response system further includes one or more toy components, and wherein generating a toy output pattern includes activating of one or more toy components.

9. The toy operating system of claim 8 wherein toy components include one or more of a drive assembly, and an audiovisual assembly.

10. The toy operating system of claim 1, further including a reservoir for containing a liquid body, wherein the reservoir is configured to be detachably coupled with the input system.

11. A toy including the toy operating system of claim 1.

12. The toy of claim 11, wherein the toy is a toy vehicle.

13. A method of operating a toy that includes a processor and a response system; the method comprising:

measuring a predetermined quantitative characteristic of a liquid body;

producing information representative of the measurement of the characteristic, including a set of one or more operational instructions for a response system configured to generate a plurality of toy output patterns;

selecting one of the plurality of predetermined toy output patterns, wherein the selection is based at least in part on the produced information;

communicating the operational instructions corresponding to the selected toy output pattern to the response system;

operating one or more toy components according to the selected toy output pattern.

14. The method of claim 13, wherein measuring a predetermined quantitative characteristic of a liquid body includes measuring the electrical conductivity of the liquid.

15. A toy vehicle operating system performing the method of claim 13.

16. A toy vehicle for use with the toy vehicle operating system of claim 15.

17. A toy vehicle comprising:

a chassis;

at least one toy component operable to display an output, the toy component including a drive assembly to move the toy vehicle across a ground surface at a plurality of predetermined rates of speed;

a chamber adapted to contain a liquid body;

an input system configured to measure a predetermined quantitative characteristic of a liquid body contained in the chamber and to operate the at least one toy component according to one of a plurality of output patterns that corresponds to such a measurement;

wherein each of the plurality of output patterns includes operating the drive assembly to move the toy vehicle across a ground surface at a corresponding one of the plurality of predetermined rates of speed.

18. The toy vehicle of claim 17, wherein the liquid receiving chamber is configured to be detachably coupled to the chassis.

19. The toy vehicle of claim 17, wherein the predetermined quantitative characteristic is electrical conductivity.

20. The toy vehicle of claim 19 wherein the liquid receiving chamber includes a pair of electrodes protruding into a liquid body contained in the chamber, and wherein the input system is adapted to generate an electrical current between the electrodes.

21. The toy vehicle of claim 17, wherein the at least one toy component is configured to be selectively operable independent of a predetermined quantitative characteristic of a liquid body contained in the chamber.

22. A toy vehicle comprising:

a chassis;

at least one toy component operable to display an output, the toy component including an audiovisual assembly to produce a plurality of predetermined audiovisual displays;

a chamber adapted to contain a liquid body;

an input system configured to measure a predetermined quantitative characteristic of a liquid body contained in the chamber and operate the at least one toy component according to one of a plurality of output patterns that corresponds to the measurement wherein each of the plurality of output patterns includes operating the audiovisual assembly to produce a corresponding one of the plurality of predetermined audiovisual displays.

23. A toy operating system, comprising:

an input system responsive to a predetermined quantitative characteristic of a liquid body;

a response system coupled to the input system and configured to generate one or more toy output patterns based at least in part on the given characteristic, the response system including an audiovisual assembly to produce an audiovisual display and a drive assembly to provide a motive force for a toy vehicle;

wherein generating a toy output pattern includes activating of one or more of the drive assembly and the audiovisual assembly.

24. The toy operating system of claim 23, wherein the audiovisual assembly further includes one or more of: a light assembly including one or more lights, and a speaker assembly including one or more speakers.

25. The toy operating system of claim 23, wherein the drive assembly further includes a motor assembly including one or more motors, coupled with a driven wheel assembly including one or more driven wheels.

* * * * *